US006554410B2

(12) United States Patent
Jeanmaire et al.

(10) Patent No.: US 6,554,410 B2
(45) Date of Patent: Apr. 29, 2003

(54) PRINTHEAD HAVING GAS FLOW INK DROPLET SEPARATION AND METHOD OF DIVERGING INK DROPLETS

(75) Inventors: David L. Jeanmaire, Brockport, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/750,946

(22) Filed: Dec. 28, 2000

(65) Prior Publication Data

US 2002/0122102 A1 Sep. 5, 2002

(51) Int. Cl.[7] ..... B41J 2/09

(52) U.S. Cl. ..... 347/77; 347/82; 347/74; 347/75

(58) Field of Search ..... 347/73, 74, 75, 347/77, 82

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,709,432 A | | 1/1973 | Robertson | |
| 3,878,519 A | | 4/1975 | Eaton | |
| 4,068,241 A | * | 1/1978 | Yamada | |
| 4,190,844 A | | 2/1980 | Taylor | |
| 4,346,387 A | | 8/1982 | Hertz | |
| 4,350,986 A | * | 9/1982 | Yamada | 347/77 |
| 4,395,716 A | | 7/1983 | Crean et al. | |
| 4,638,328 A | | 1/1987 | Drake et al. | |
| 4,914,522 A | | 4/1990 | Duffield et al. | |
| 5,224,843 A | | 7/1993 | VanLintel | |
| 6,079,821 A | | 6/2000 | Chwalek et al. | |

FOREIGN PATENT DOCUMENTS

| | | | | |
|---|---|---|---|---|
| EP | 494385 | * | 7/1992 | |
| EP | 1016526 | * | 7/2000 | 347/77 |
| EP | 1016527 | * | 7/2000 | 347/77 |
| SU | 581478 | * | 11/1977 | 347/82 |

OTHER PUBLICATIONS

U.S. patent application Ser. No. 09/751,232 as originally filed, Dec. 28, 2000.

* cited by examiner

*Primary Examiner*—Huan Tran
(74) *Attorney, Agent, or Firm*—William R. Zimmerli

(57) ABSTRACT

An apparatus for printing an image is provided. The apparatus includes an ink droplet forming mechanism operable to selectively create a stream of ink droplets having a plurality of volumes and a droplet deflector having a gas source. The gas source is positioned at an angle with respect to the stream of ink droplets and is operable to interact with the stream of ink droplets thereby separating ink droplets having one of the plurality of volumes from ink droplets having another of the plurality of volumes. The ink droplet producing mechanism has a nozzle and includes a heater positioned proximate to the nozzle. The heater may be selectively actuated at a plurality of frequencies to create the stream of ink droplets having the plurality of volumes. The heater may include an electrical resistance heating element. The gas source may be a positive pressure air source positioned substantially perpendicular to the stream of ink droplets.

59 Claims, 9 Drawing Sheets

PRINTHEAD HAVING GAS FLOW INK DROPLET SEPARATION AND METHOD OF DIVERGING INK DROPLETS

FIELD OF THE INVENTION

This invention relates generally to the field of digitally controlled printing devices, and in particular to continuous ink jet printers in which a liquid ink stream breaks into droplets, some of which are selectively deflected.

BACKGROUND OF THE INVENTION

Traditionally, digitally controlled color printing capability is accomplished by one of two technologies. Both require independent ink supplies for each of the colors of ink provided. Ink is fed through channels formed in the printhead. Each channel includes a nozzle from which droplets of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce, in general, up to several million shades or color combinations.

The first technology, commonly referred to as "droplet on demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle helping to keep the nozzle clean.

Conventional "droplet on demand" ink jet printers utilize a pressurization actuator to produce the ink jet droplet at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, a mechanical stress is applied to a piezoelectric material possessing properties that create an electric field in the material causing an ink droplet to be expelled. Alternatively, an electric field is applied to a piezoelectric material possessing properties that create a mechanical stress in the material causing an ink droplet to be expelled. Some naturally occurring materials possessing these characteristics are quartz and tourmaline. The most commonly produced piezoelectric ceramics are lead zirconate titanate, barium titanate, lead titanate, and lead metaniobate.

For example, in a bubble jet printer, ink in a channel of a printhead is heated creating a bubble which increases internal pressure ejecting an ink droplet out of a nozzle of the printhead. The bubble then collapses as the heating element cools, and the resulting vacuum draws fluid from a reservoir to replace ink that was ejected from the nozzle. Piezoelectric actuators, such as that disclosed in U.S. Pat. No. 5,224,843, issued to vanLintel, on Jul. 6, 1993, have a piezoelectric crystal in an ink fluid channel that flexes when an electric current flows through it forcing an ink droplet out of a nozzle.

U.S. Pat. No. 4,914,522 issued to Duffield et al., on Apr. 3, 1990 discloses a drop on demand ink jet printer that utilizes air pressure to produce a desired color density in a printed image. Ink in a reservoir travels through a conduit and forms a meniscus at an end of an inkjet nozzle. An air nozzle, positioned so that a stream of air flows across the meniscus at the end of the ink nozzle, causes the ink to be extracted from the nozzle and atomized into a fine spray. The stream of air is applied at a constant pressure through a conduit to a control valve. The valve is opened and closed by the action of a piezoelectric actuator. When a voltage is applied to the valve, the valve opens to permit air to flow through the air nozzle. When the voltage is removed, the valve closes and no air flows through the air nozzle. As such, the ink dot size on the image remains constant while the desired color density of the ink dot is varied depending on the pulse width of the air stream.

The dot resolution of the printhead is dependent upon the spacing of the individual nozzles; the closer and smaller the nozzles, the greater the resolution. As this technology requires separate ink delivery systems for each color of ink, typically, at least three ink channels are required to produce the necessary colors. This tends to degrade the overall image resolution because nozzles must be spaced further apart.

The second technology, commonly referred to as "continuous stream" or "continuous" ink jet printing, uses a pressurized ink source which produces a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When print is desired, the ink droplets are not deflected and allowed to strike a print media. Alternatively, deflected ink droplets may be allowed to strike the print media, while non-deflected ink droplets are collected in the ink capturing mechanism.

Typically, continuous ink jet printing devices are faster than droplet on demand devices and produce higher quality printed images and graphics. However, each color printed requires an individual droplet formation, deflection, and capturing system.

U.S. Pat. No. 1,941,001, issued to Hansell, on Dec. 26, 1933, and U.S. Pat. No. 3,373,437 issued to Sweet et al., on Mar. 12, 1968, each disclose an array of continuous ink jet nozzles wherein ink droplets to be printed are selectively charged and deflected towards the recording medium. This technique is known as binary deflection continuous ink jet.

U.S. Pat. No. 3,416,153, issued to Hertz et al., on Oct. 6, 1963, discloses a method of achieving variable optical density of printed spots in continuous ink jet printing using the electrostatic dispersion of a charged droplet stream to modulate the number of droplets which pass through a small aperture.

U.S. Pat. No. 3,878,519, issued to Eaton, on Apr. 15, 1975, discloses a method and apparatus for synchronizing droplet formation in a liquid stream using electrostatic deflection by a charging tunnel and deflection plates.

U.S. Pat. No. 4,346,387, issued to Hertz, on Aug. 24, 1982, discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat. No. 4,638,382, issued to Drake et al., on Jan. 20, 1987, discloses a continuous ink jet printhead that utilizes constant thermal pulses to agitate ink streams admitted through a plurality of nozzles in order to break up the ink streams into droplets at a fixed distance from the nozzles. At this point, the droplets are individually charged by a charging electrode and then deflected using deflection plates positioned the droplet path.

As conventional continuous ink jet printers utilize electrostatic charging devices and deflector plates, they require many components and large spatial volumes in which to operate. This results in continuous ink jet printheads and printers that are complicated, have high energy requirements, are difficult to manufacture, and are difficult to control.

U.S. Pat. No. 3,709,432, issued to Robertson, on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets it does rely on the precise control of the break off points of the filaments and the placement of the air flow intermediate to these break off points. Such a system is difficult to control and to manufacture. Furthermore, the physical separation or amount of discrimination between the two droplet paths is small further adding to the difficulty of control and manufacture.

U.S. Pat. No. 4,190,844, issued to Taylor, on Feb. 26, 1980, discloses a continuous ink jet printer having a first pneumatic deflector for deflecting non-printed ink droplets to a catcher and a second pneumatic deflector for oscillating printed ink droplets. A printhead supplies a filament of working fluid that breaks into individual ink droplets. The ink droplets are then selectively deflected by a first pneumatic deflector, a second pneumatic deflector, or both. The first pneumatic deflector is an "on/off" or an "open/closed" type having a diaphram that either opens or closes a nozzle depending on one of two distinct electrical signals received from a central control unit. This determines whether the ink droplet is to be printed or non-printed. The second pneumatic deflector is a continuous type having a diaphram that varies the amount a nozzle is open depending on a varying electrical signal received the central control unit. This oscillates printed ink droplets so that characters may be printed one character at a time. If only the first pneumatic deflector is used, characters are created one line at a time, being built up by repeated traverses of the printhead.

While this method does not rely on electrostatic means to affect the trajectory of droplets it does rely on the precise control and timing of the first ("open/closed") pneumatic deflector to create printed and non-printed ink droplets. Such a system is difficult to manufacture and accurately control resulting in at least the ink droplet build up discussed above. Furthermore, the physical separation or amount of discrimination between the two droplet paths is erratic due to the precise timing requirements increasing the difficulty of controlling printed and non-printed ink droplets resulting in poor ink droplet trajectory control.

Additionally, using two pneumatic deflectors complicates construction of the printhead, requires more components, and reduces print speed. The additional components and complicated structure require large spatial volumes between the printhead and the media, increasing the ink droplet trajectory distance. Increasing the distance of the droplet trajectory decreases droplet placement accuracy and affects the print image quality. Print speed is reduced because two air valves must be turned on and off. Again, there is a need to minimize the distance the droplet must travel before striking the print media in order to insure high quality images. There is also a need to maintain and/or improve print speed.

U.S. Pat. No. 6,079,821, issued to Chwalek et al., on Jun. 27, 2000, discloses a continuous ink jet printer that uses actuation of asymmetric heaters to create individual ink droplets from a filament of working fluid and deflect thoses ink droplets. A printhead includes a pressurized ink source and an asymmetric heater operable to form printed ink droplets and non-printed ink droplets. Printed ink droplets flow along a printed ink droplet path ultimately striking a print media, while non-printed ink droplets flow along a non-printed ink droplet path ultimately striking a catcher surface. Non-printed ink droplets are recycled or disposed of through an ink removal channel formed in the catcher.

While the ink jet printer disclosed in Chwalek et al. works extremely well for its intended purpose, using a heater to create and deflect ink droplets increases the energy and power requirements of this device.

It can be seen that there is a need to provide an ink jet printhead and printer of simple construction having simplified control of individual ink droplets; an increased amount of physical separation between printed and non-printed ink droplets; an increased amount of deflection for non-printed ink droplets; and reduced energy and power requirements capable of rendering high quality images on a wide variety of materials using a wide variety of inks.

SUMMARY OF THE INVENTION

An object of the present invention is to simplify construction of a continuous ink jet printhead.

Another object of the present invention is to simplify control of individual ink droplets in a continuous ink jet printhead.

Yet another object of the present invention is to increase the amount of physical separation between ink droplets of a printed ink droplet path and ink droplets of a non-printed ink droplet path.

Yet another object of the present invention is to increase the amount of deflection of non-printed ink droplets.

Yet another object of the present invention is to reduce energy and power requirements of a continuous ink jet printer.

Yet another object of the present invention is to improve the capability of a continuous ink jet printhead for rendering images using a large volume of ink.

Yet another object of the present invention is to simplify construction and operation of a continuous ink jet printer suitable for printing with a wide variety of inks including aqueous and non-aqueous solvent inks containing pigments and/or dyes on a wide variety of materials including paper, vinyl, cloth and other large fibrous materials.

According to a feature of the present invention, an apparatus for printing an image includes an ink droplet forming mechanism operable to selectively create a stream of ink droplets having a plurality of volumes. Additionally, a droplet deflector having a gas source is positioned at an angle with respect to the stream of ink droplets and is operable to interact with the stream of ink droplets. The interaction separates ink droplets having one volume from ink droplets having other volumes.

According to another feature of the present invention, the ink droplet producing mechanism has a nozzle and may include a heater positioned proximate the nozzle. The heater is operable to selectively create the stream of ink droplets having the plurality of volumes.

According to another feature of the present invention, the heater is operable to be selectively actuated at a plurality of frequencies thereby creating the stream of ink droplets having the plurality of volumes.

According to another feature of the present invention, an ink jet printer for printing an image includes a printhead having a nozzle operable to selectively create a stream of ink droplets having a plurality of volumes. Additionally, a droplet deflector having a gas source is positioned at an angle with respect to the stream of ink droplets. The droplet deflector is operable to interact with the stream of ink droplets. The interaction separates ink droplets having one volume from ink droplets having other volumes.

According to another feature of the present invention, a heater may be positioned proximate to the nozzle with the heater selectively creating the stream of ink droplets having a plurality of volumes.

According to another feature of the present invention, a controller may be electrically coupled to the heater. The controller may selectively actuate the heater at a plurality of frequencies, thereby creating the stream of ink droplets having a plurality of volumes.

According to another feature of the present invention, an apparatus for printing an image includes a droplet forming mechanism. The droplet forming mechanism is operable in a first state to form droplets having a first volume travelling along a path and in a second state to form droplets having a second volume travelling along said path. A droplet deflector applies force to the droplets travelling along the path. The force is applied in a direction such as to separate droplets having the first volume from droplets having the second volume.

According to another feature of the present invention, the force may be a positive pressure force. The force may also be a negative pressure force. The force may also be applied in a direction substantially perpendicular to the path. The force may also include a gas flow.

According to another feature of the present invention, a method of printing an image on a printing media includes selectively forming a stream of ink droplets having a plurality of volumes; providing a gas source at an angle with respect to the stream of ink droplets; separating ink droplets having one volume in the stream of ink droplets from ink droplets having other volumes in the stream of ink droplets; collecting the ink droplets having one volume; and allowing the ink droplets having another volume to contact a print media.

According to another feature of the present invention, a method of diverging ink droplets includes forming droplets having a first volume travelling along a path; forming droplets having a second volume travelling along the path; and causing at least the droplets having the first volume to diverge from the path.

According to another feature of the present invention, causing at least the droplets having the first volume to diverge from the path may include applying a force to at least the droplets having the first volume. Applying the force may include applying the force along the path.

According to another feature of the present invention, applying the force may include applying the force in a direction such as to separate the droplets having the first volume from droplets having the second volume. Additionally, applying the force may include applying the force in a direction substantially perpendicular to the path.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
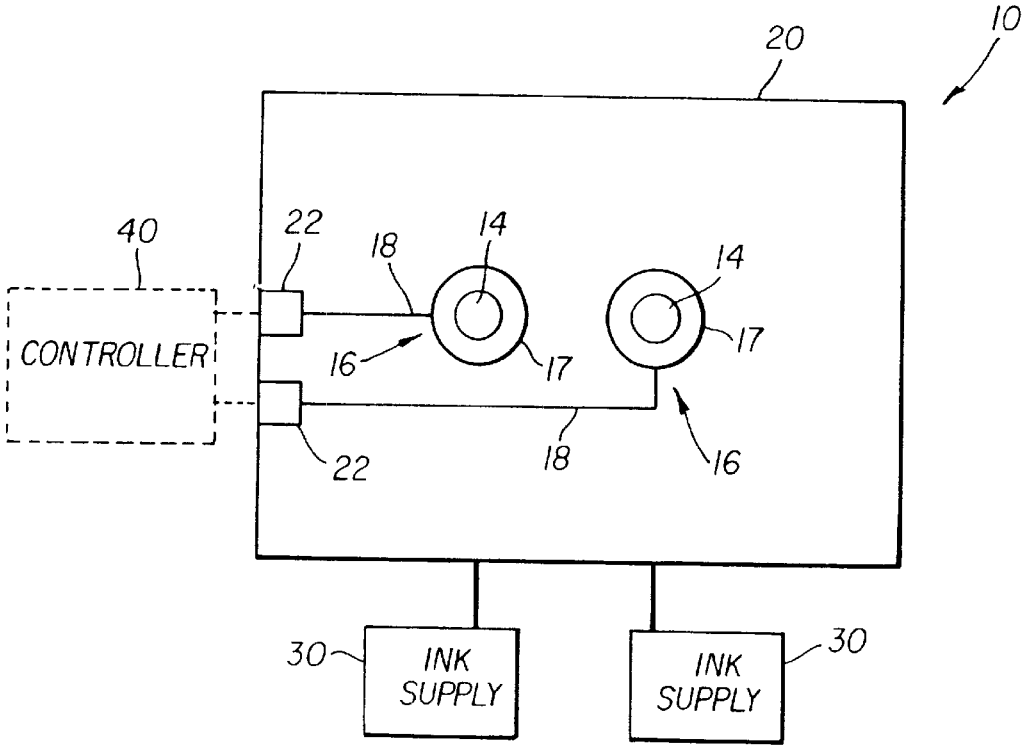
FIG. 1 is a schematic view of a printhead made in accordance with a preferred embodiment of the present invention.

Referring to FIG. 1, an ink droplet forming mechanism 10 of a preferred embodiment of the present invention is shown. Mechanism 10 includes a printhead 20, at least one ink supply 30, and a controller 40. Although mechanism 10 is illustrated schematically and not to scale for the sake of clarity, one of ordinary skill in the art will be able to readily determine the specific size and interconnections of the elements of the preferred.

In a preferred embodiment of the present invention, printhead 20 is formed from a semiconductor material (silicon, etc.) using known semiconductor fabrication techniques (CMOS circuit fabrication techniques, micro electro mechanical structure (MEMS) fabrication techniques, etc.). However, it is specifically contemplated and, therefore within the scope of this disclosure, that printhead 20 may be formed from any materials using any fabrication techniques conventionally known in the art.

Again referring to FIG. 1, at least one nozzle 14 is formed on printhead 20. Nozzle 14 is in fluid communication with ink supply 30 through an ink passage (not shown) also formed in printhead 20. In a preferred embodiment, printhead 20 has two ink supplies 30 in fluid communication with two nozzles 14, respectively. Each ink supply 30 may contain a different color ink for color printing. However, it is specifically contemplated, therefore within the scope of this disclosure, that printhead 20 may incorporate additional ink supplies 30 and corresponding nozzles 14 in order to provide color printing using three or more ink colors. Additionally, black and white or single color printing may be accomplished using a single ink supply 30 and nozzle 14.

A heater 16 is at least partially formed or positioned on printhead 20 around a corresponding nozzle 14. Although heater 16 may be disposed radially away from an edge 15 of corresponding nozzle 14, heater 16 is preferably disposed close to edge 15 of corresponding nozzle 14 in a concentric manner. In a preferred embodiment, heater 16 is formed in a substantially circular or ring shape. However, it is specifically contemplated, therefore within the scope of this disclosure, that heater 16 may be formed in a partial ring, square, etc. Heater 16 also includes an electric resistive heating element 17 electrically connected to pad 22 via conductor 18.

Conductor 18 and pad 22 may be at least partially formed or positioned on printhead 20 and provide an electrical connection between controller 40 and heater 16. Alternatively, the electrical connection between controller 40 and heater 16 may be accomplished in any well known manner. Additionally, controller 40 may be a relatively simple device (a power supply for heater 16, etc.) or a relatively complex device (logic controller, programmable microprocessor, etc.) operable to control many components (heater 16, mechanism 10, etc.) in a desired manner.

Figure 2:
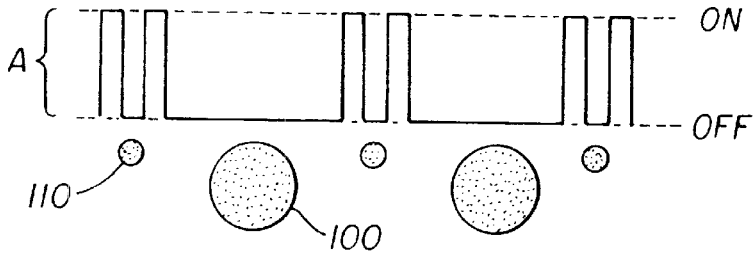
FIG. 2 is a diagram illustrating a frequency control of a heater used in the preferred embodiment of FIG. 1.

Referring to FIG. 2, an example of the activation frequency provided by controller 40 to heater 16 (shown generally as curve A) and the resulting individual ink droplets 100 and 110 are shown. A high frequency of activation of heater 16 results in small volume droplets 110 and a low frequency of activation of heater 16 results in large volume droplets 100. Activation of heater 16 may be controlled independently based on the ink color required and ejected through corresponding nozzle 14; movement of printhead 20 relative to a print media W; and an image to be printed. It is specifically contemplated, and therefore within the scope of this disclosure, that a plurality of droplets may be created having a plurality of volumes, including a mid-range activation frequency of heater 16 resulting in a medium volume droplet, etc. As such, reference below to large volume droplets 100 and small volume droplets 110 is for example purposes only and should not be interpreted as being limiting in any manner.

Figure 3:
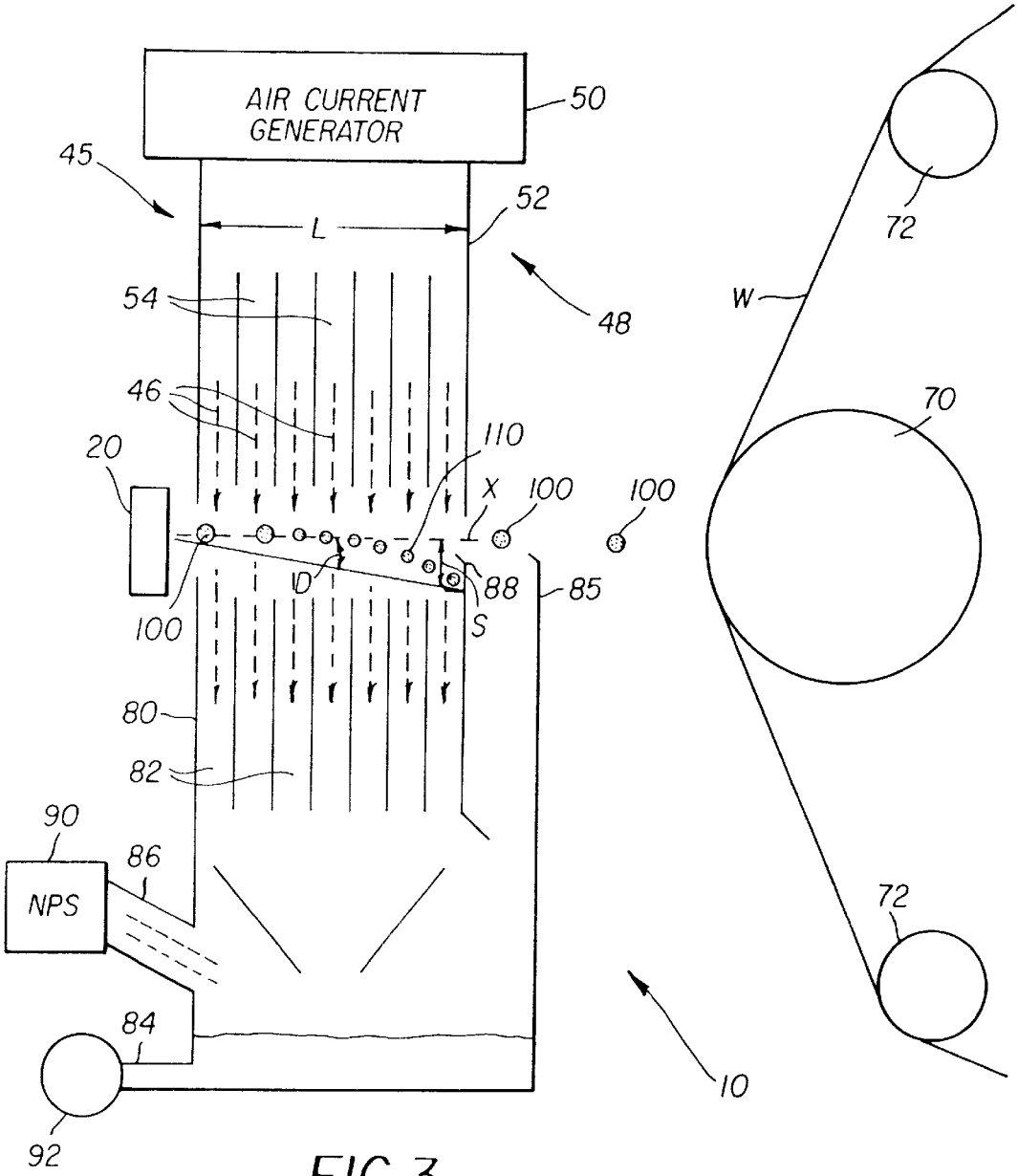
FIG. 3 is a schematic view of an ink jet printer made in accordance with the preferred embodiment of the present invention.

Referring to FIG. 3, an apparatus (typically, an ink jet printer or printhead) made in accordance with the present invention is shown. Large volume ink droplets 100 and small volume ink droplets 110 are ejected from ink droplet forming mechanism 10 substantially along ejection path X in a stream. A droplet deflector system 45 applies a force (shown generally at 46) to ink droplets 100, 110 as ink droplets 100, 110 travel along path X. Force 46 interacts with ink droplets 100, 110 along path X, causing the ink droplets 100, 110 to alter course. As ink droplets 100, 110 have different volumes and masses, force 46 causes small droplets 110 to separate from large droplets 100 with small droplets 110 diverging from path X along deflection angle D. While large droplets 100 can be slightly affected by force 46, large droplets 100 remain travelling substantially along path X.

Droplet deflector system 45 can include a gas source 48 that provides force 46. Typically, force 46 is positioned at an angle with respect to the stream of ink droplets operable to selectively deflect ink droplets depending on ink droplet volume. Ink droplets having a smaller volume are deflected more than ink droplets having a larger volume.

Gas source 48 of droplet deflector system 45 includes a gas pressure generator 50 coupled to a plenum 52 having at least one baffle 54 to facilitate laminar flow of gas through plenum 52. An end of plenum 52 is positioned proximate path X. A recovery plenum 80 is disposed opposite plenum 52 and includes at least one baffle 82. Additionally, baffle 82 includes catcher surface 88 defined on a surface thereof proximate path X. Alternatively, a surface of recovery plenum 80 may define a catcher surface thereon. An ink recovery conduit 84 communicates with recovery plenum 80 to facilitate recovery of non-printed ink droplets by an ink recycler 92 for subsequent use. Additionally, a vacuum conduit 86, coupled to a negative pressure source 90, can communicate with recovery plenum 80 to create a negative pressure in recovery plenum 80 improving ink droplet separation and ink droplet removal.

Figure 4:
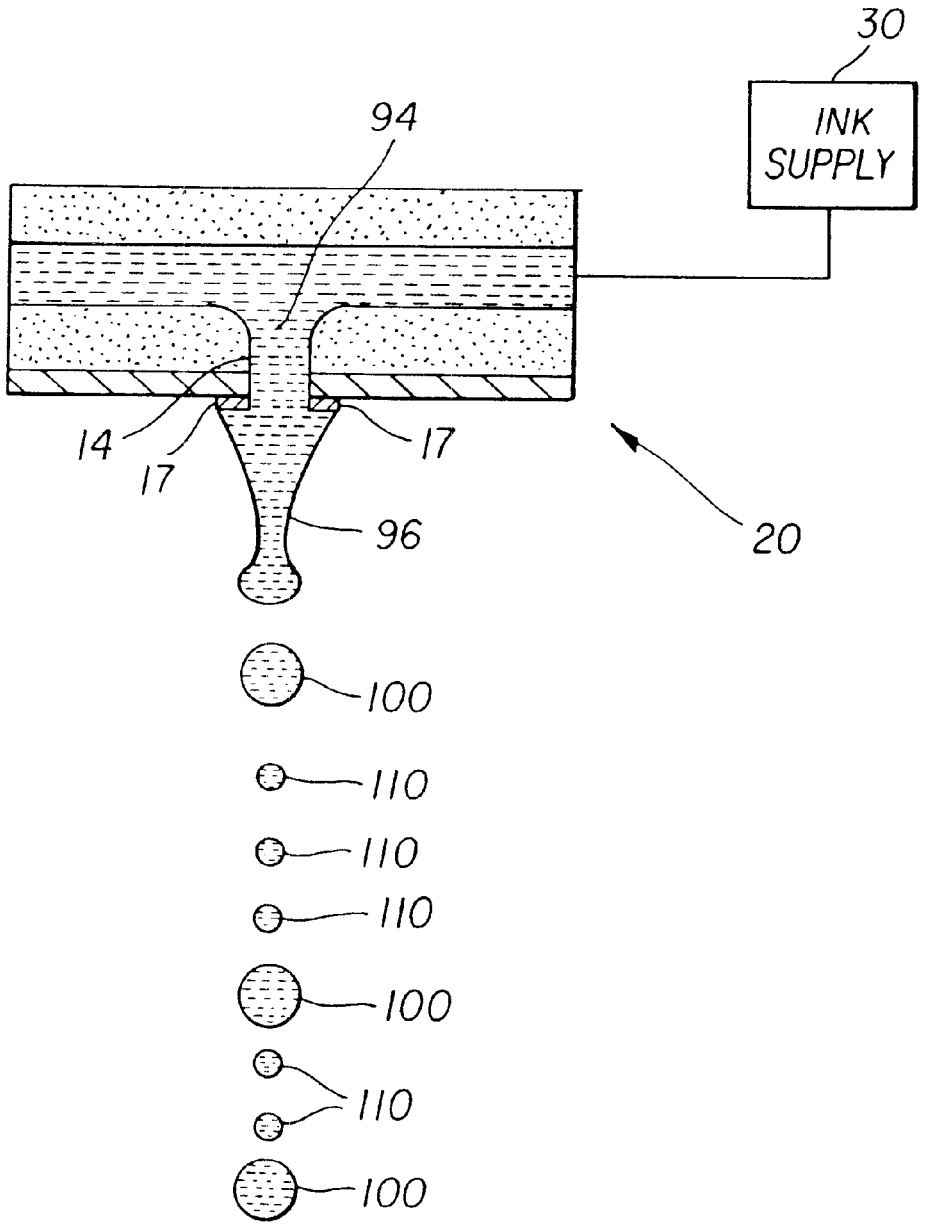
FIG. 4 is a cross-sectional view of an ink jet printhead made in accordance with the preferred embodiment of the present invention.

In operation, a print media W is transported in a direction transverse to axis x by a drive roller 70 and idle rollers 72 in a known manner. Transport of print media W is coordinated with movement of mechanism 10 and/or movement of printhead 20. This can be accomplished using controller 40 in a known manner. Referring to FIG. 4, pressurized ink 94 from ink supply 30 is ejected through nozzle 14 of printhead 20 creating a filament of working fluid 96. Heater 16 is selectively activated at various frequencies causing filament of working fluid 96 to break up into a stream of individual ink droplets 98 with each ink droplet (100, 110) having a volume. The volume of each ink droplet (100, 110) depends on the frequency of activation of heater 16.

During printing, heater 16 is selectively activated creating the stream of ink having a plurality of ink droplets having a plurality of volumes and droplet deflector system 45 is operational. After formation, large volume droplets 100 also have a greater mass and more momentum than small volume droplets 110. As gas source 48 interacts with the stream of ink droplets, the individual ink droplets separate depending on each droplets volume and mass. Accordingly, gas source 48 can be adjusted to permit large volume droplets 100 to strike print media W while small volume droplets 110 are deflected as they travel downward and strike catcher surface 88 or otherwise to fall into recovery plenum 80.

With reference to a preferred embodiment, a positive gas pressure or gas flow at one end of plenum 52 tends to separate and deflect ink droplets toward recovery plenum 80 as the ink droplets travel toward print media W. Splashguard 85 prevents ink received in recovery plenum 80 from splattering onto print media W. Accordingly, heater 16 can be controlled in a coordinated manner to cause ink of various colors to impinge on print media W to form an image.

An amount of separation between the large volume droplets 100 and the small volume droplets 110 (shown as S in FIG. 3) will not only depend on their relative size but also the velocity, density, and viscosity of the gas coming from gas source 48; the velocity and density of the large volume droplets 100 and small volume droplets 110; and the interaction distance (shown as L in FIG. 3) over which the large volume droplets 100 and the small volume droplets 110 interact with the gas from gas source 48. Gases, including air, nitrogen, etc., having different densities and viscosities can also be used with similar results.

Large volume droplets 100 and small volume droplets 110 can be of any appropriate relative size. However, the droplet size is primarily determined by ink flow rate through nozzle 14 and the frequency at which heater 16 is cycled. The flow rate is primarily determined by the geometric properties of nozzle 14 such as nozzle diameter and length, pressure applied to the ink, and the fluidic properties of the ink such as ink viscosity, density, and surface tension. As such, typical ink droplet sizes may range from, but are not limited to, 1 to 10,000 picoliters.

Although a wide range of droplet sizes are possible, at typical ink flow rates, for a 12 micron diameter nozzle, large volume droplets 100 can be formed by cycling heaters at a frequency of about 10 kHz producing droplets of about 60 microns in diameter and small volume droplets 110 can be formed by cycling heaters at a frequency of about 150 kHz producing droplets that are about 25 microns in diameter. These droplets typically travel at an initial velocity of 10 m/s. Even with the above droplet velocity and sizes, a wide range of separation distances S between large volume and small volume droplets is possible depending on the physical properties of the gas used, the velocity of the gas and the interaction distance L, as stated previously. For example, when using air as the gas, typical air velocities may range from, but are not limited to 100 to 1000 cm/s while interaction distances L may range from, but are not limited to, 0.1 to 10 mm.

Using gas source 48 to deflect printed and non-printed into droplets, allows mechanism 10 to accommodate a wide variety of inks. The ink can be of any type, including aqueous and non-aqueous solvent based inks containing either dyes or pigments, etc. Additionally, plural colors or a single color ink can be used. For example, a typical ink (black in color) composition includes 3.5% dye (Reactive Black 31, available from Tricon Colors), 3% diethylene glycol, with the balance being deionized water.

This ability to use any type of ink and to produce a wide variety of droplet sizes, separation distances, and droplet deflections (shown as angle D in FIG. 3) allows printing on a wide variety of materials including paper, vinyl, cloth, other large fibrous materials, etc. The invention has very low energy and power requirements because only a small amount of power is required to form large volume droplets 100 and small volume droplets 110. Additionally, mechanism 10 does not require electrostatic charging and deflection devices. While helping to reduce power requirements, this also simplifies construction of mechanism 10 and control of droplets 100 and 110.

Ink droplet forming mechanism 10 can be manufactured using known techniques, such as CMOS and MEMS techniques. Additionally, mechanism 10 can incorporate a heater, a piezoelectric actuator, a thermal actuator, etc. There can be any number of nozzles 14 and the separation between nozzles 14 can be adjusted in accordance with the particular application to avoid smearing and deliver the desired resolution.

Droplet deflector system 45 can be of any type and can include any number of appropriate plenums, conduits, blowers, fans, etc. Additionally, droplet deflector system 45 can include a positive pressure source, a negative pressure source, or both, and can include any elements for creating a pressure gradient or gas flow. Recovery plenum 80 can be of any configuration for catching deflected droplets and can be ventilated if necessary. Gas source 48 can be any appropriate source, including gas pressure generator 50, any service for moving air, a fan, a turbine, a blower, electrostatic air moving device, etc. Gas source 48 and gas pressure generator 50 can craft gas flow in any appropriate direction and can produce a positive or negative pressure.

Print media W can be of any type and in any form. For example, the print media can be in the form of a web or a sheet. Additionally, print media W can be composed from a wide variety of materials including paper, vinyl, cloth, other large fibrous materials, etc. Any mechanism can be used for moving the printhead relative to the media, such as a conventional raster scan mechanism, etc.

Printhead 20 can be formed using a silicon substrate, etc. Printhead 20 can be of any size and components thereof can have various relative dimensions. Heater 16, pad 22, and conductor 18 can be formed and patterned through vapor deposition and lithography techniques, etc. Heater 16 can include heating elements of any shape and type, such as resistive heaters, radiation heaters, convection heaters, chemical reaction heaters (endothermic or exothermic), etc. The invention can be controlled in any appropriate manner. As such, controller 40 can be of any type, including a microprocessor based device having a predetermined program, etc.

Referring to FIGS. 5A–5E, alternative embodiments of the present invention are shown with like elements being described using like reference signs. Droplet deflector system 45 applies force (shown generally at 46) to ink droplets 100, 110 as ink droplets 100, 110 travel along path X. Force 46 interacts with ink droplets 100, 110 along path X, causing the ink droplets 100, 110 to alter course. As ink droplets 100, 110 have different volumes and masses, force 46 causes small droplets 110 to separate from large droplets 100 with small droplets 110 diverging from path X along deflection angle D. While large droplets 100 can be slightly affected by force 46, large droplets 100 remain travelling substantially along path X.

Figure 5A:
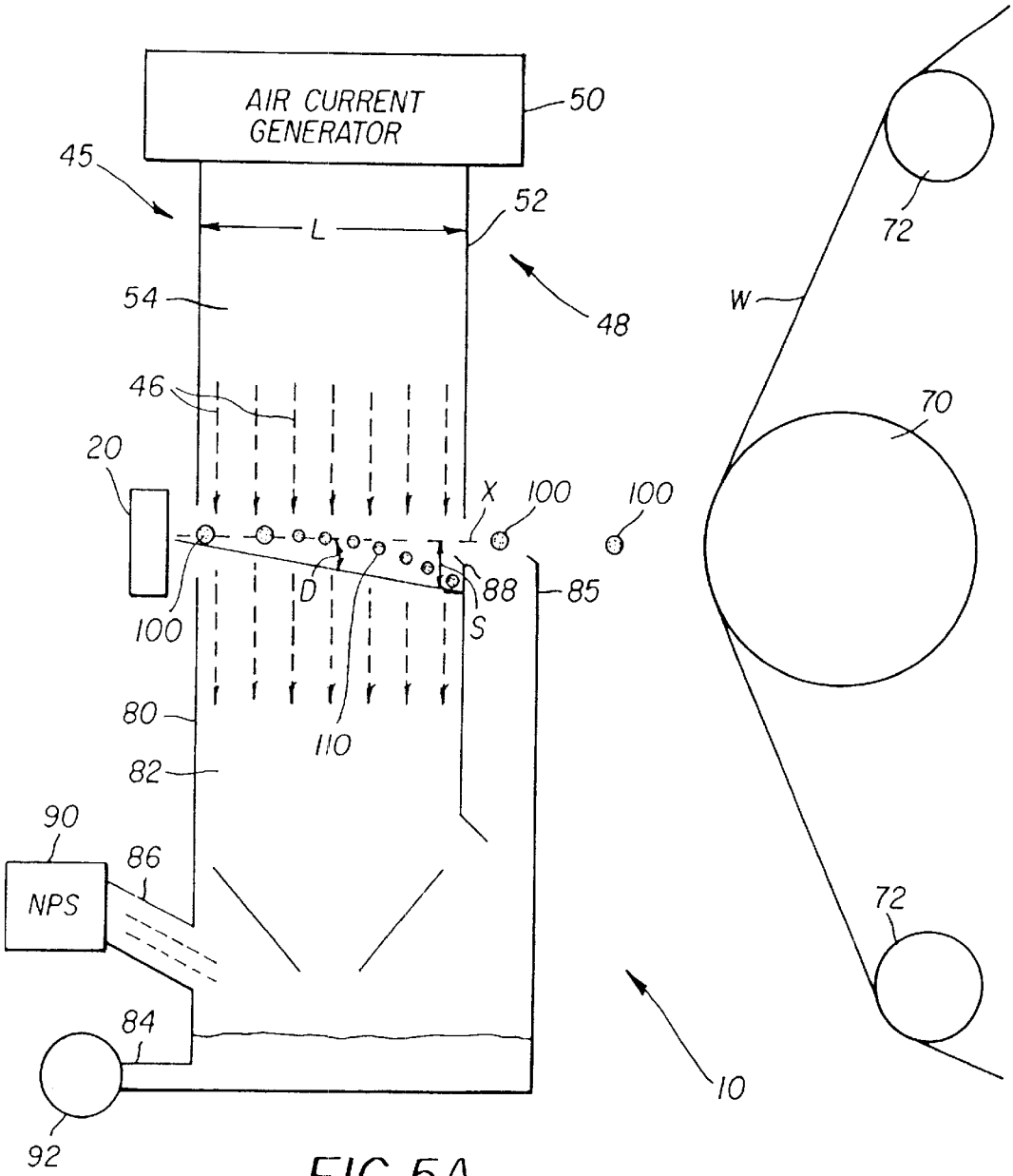
FIG. 5A is a schematic view of an alternative embodiment made in accordance with the present invention.

In FIG. 5A, force 46 is a positive gas flow (positive pressure) produced by gas source 48 (positive pressure source) and a negative gas flow (negative pressure) produce by negative pressure source 90 (a vacuum source, etc.). Additionally, plenum 52 and recovery plenum 80 are formed without baffles 54, 82.

Figure 5B:
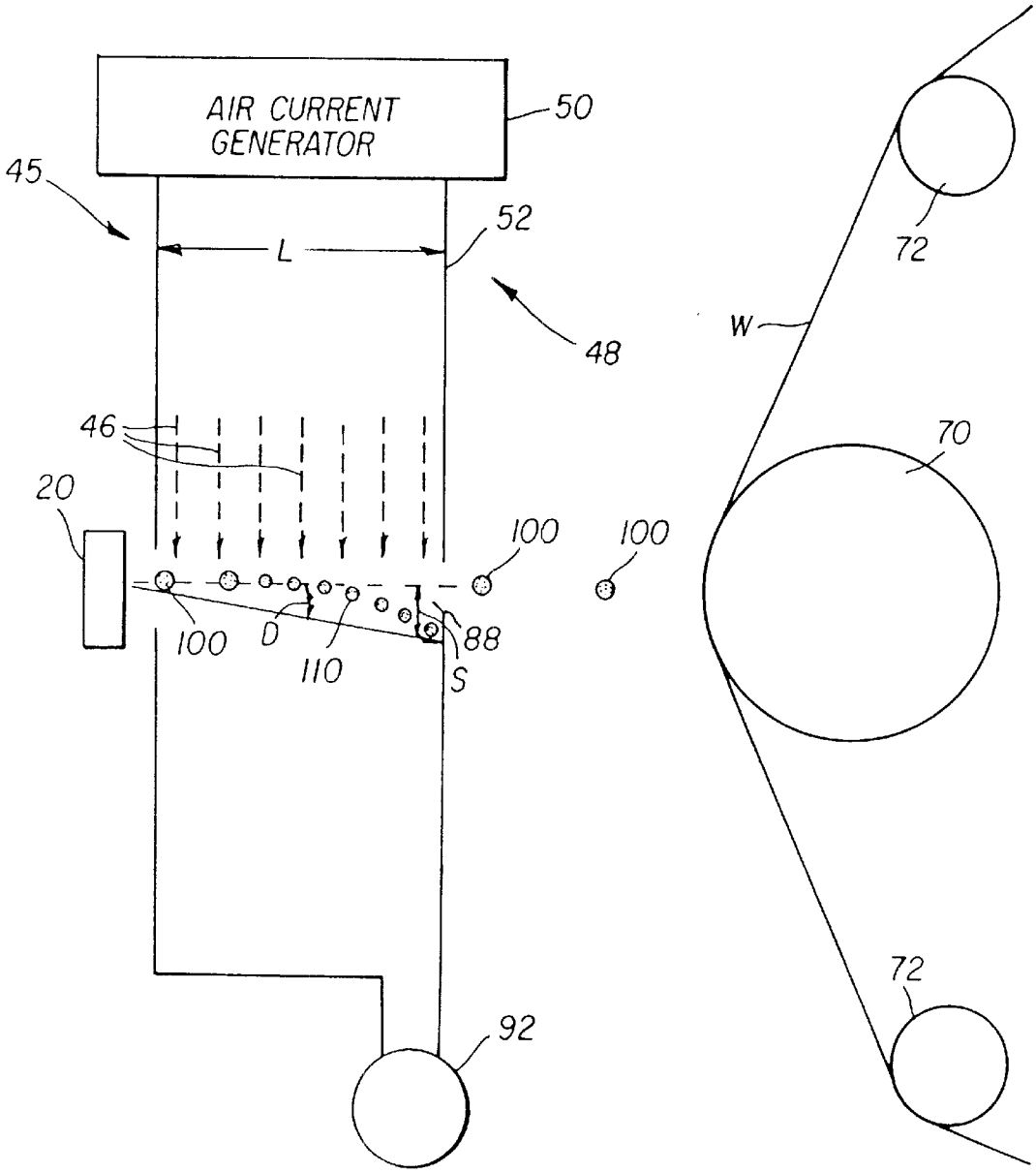
FIG. 5B is a schematic view of an alternative embodiment made in accordance with the present invention.
Figure 5C:
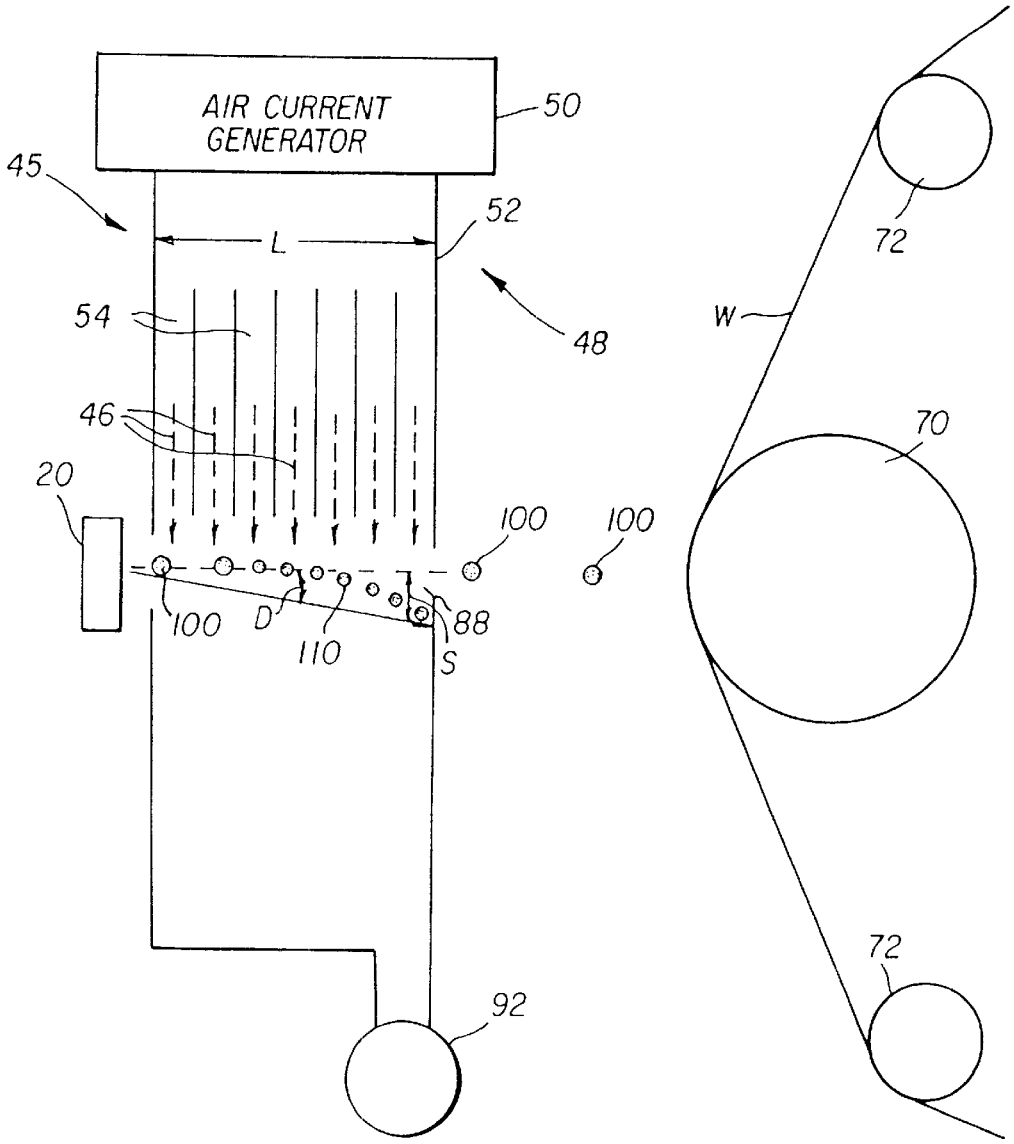
FIG. 5C is a schematic view of an alternative embodiment made in accordance with the present invention.

In FIGS. 5B and 5C, force 46 is a positive gas flow (positive pressure) produced by gas source 48 (positive pressure source). Additionally, plenum 52 and recovery plenum 80 are formed without baffles 54, 82 (FIG. 5B) and with baffles 54, 82 (FIG. 5C).

Figure 5D:
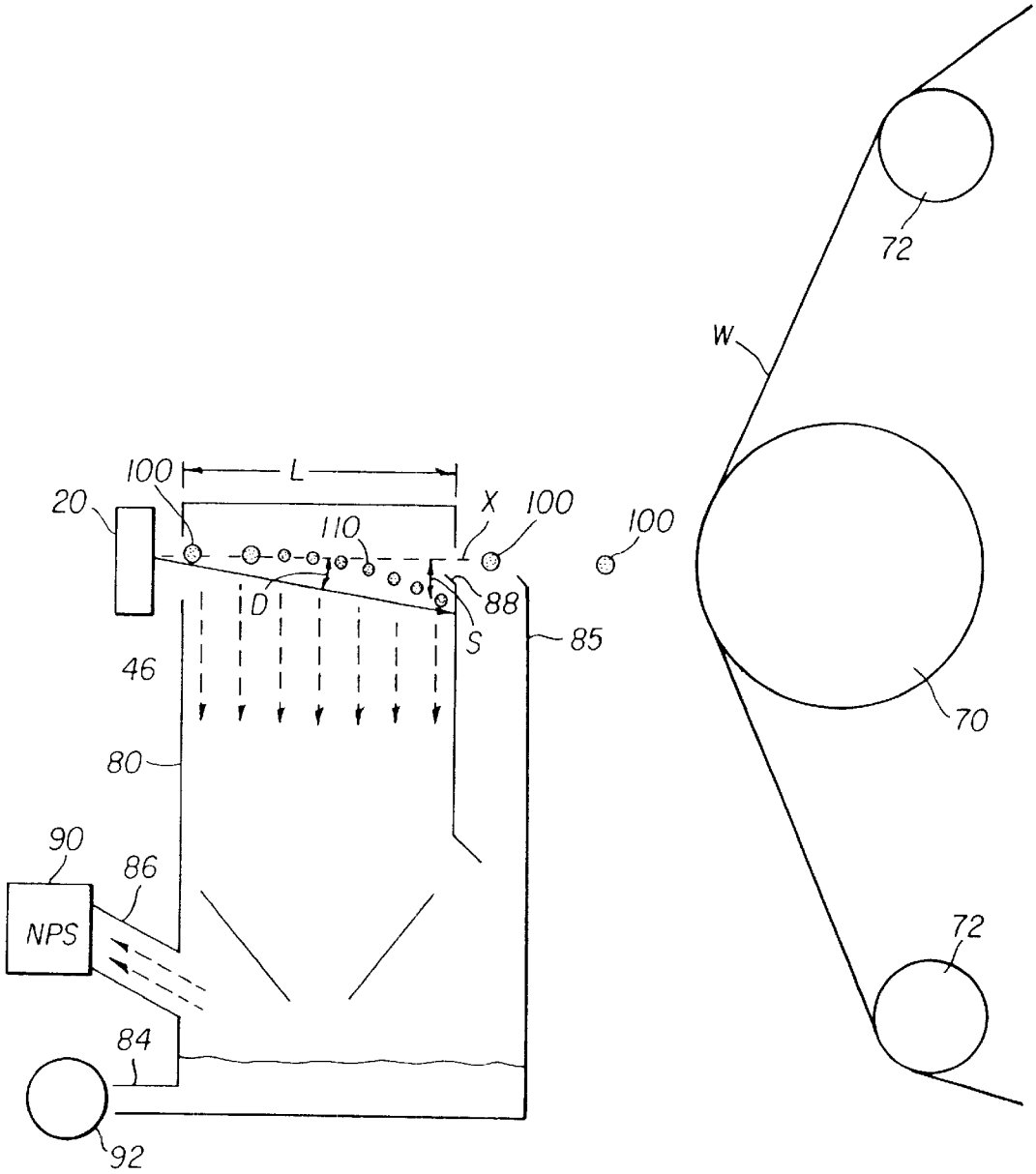
FIG. 5D is a schematic view of an alternative embodiment made in accordance with the present invention.
Figure 5E:
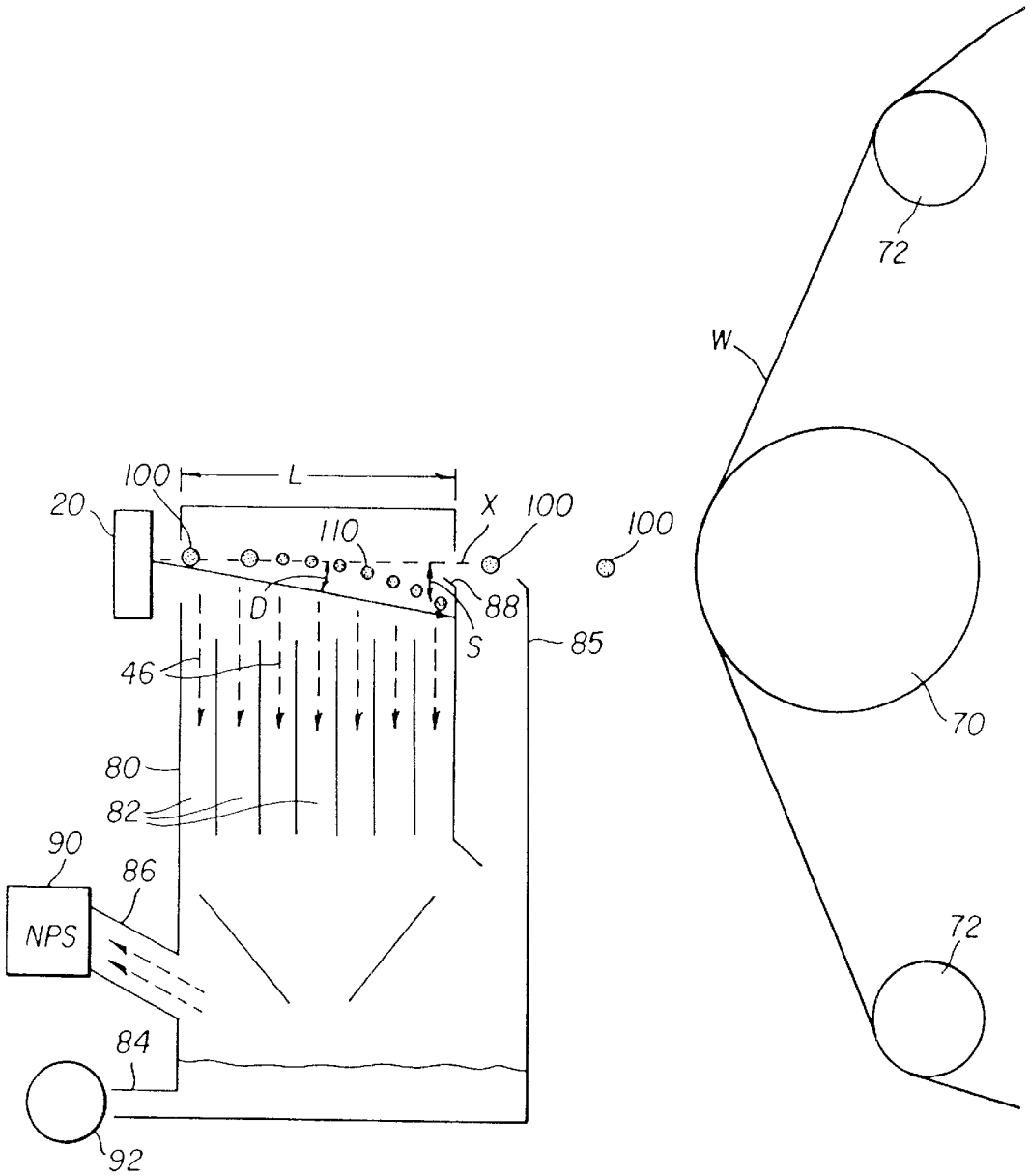
FIG. 5E is a schematic view of an alternative embodiment made in accordance with the present invention.

In FIGS. 5D and 5E, force 46 is a negative gas flow (negative pressure) produce by negative pressure source 90 (a vacuum source, etc.). Additionally, plenum 52 and recovery plenum 80 are formed without baffles 54, 82 (FIG. 5D) and with baffles 54, 82 (FIG. 5E).

Figure 6:
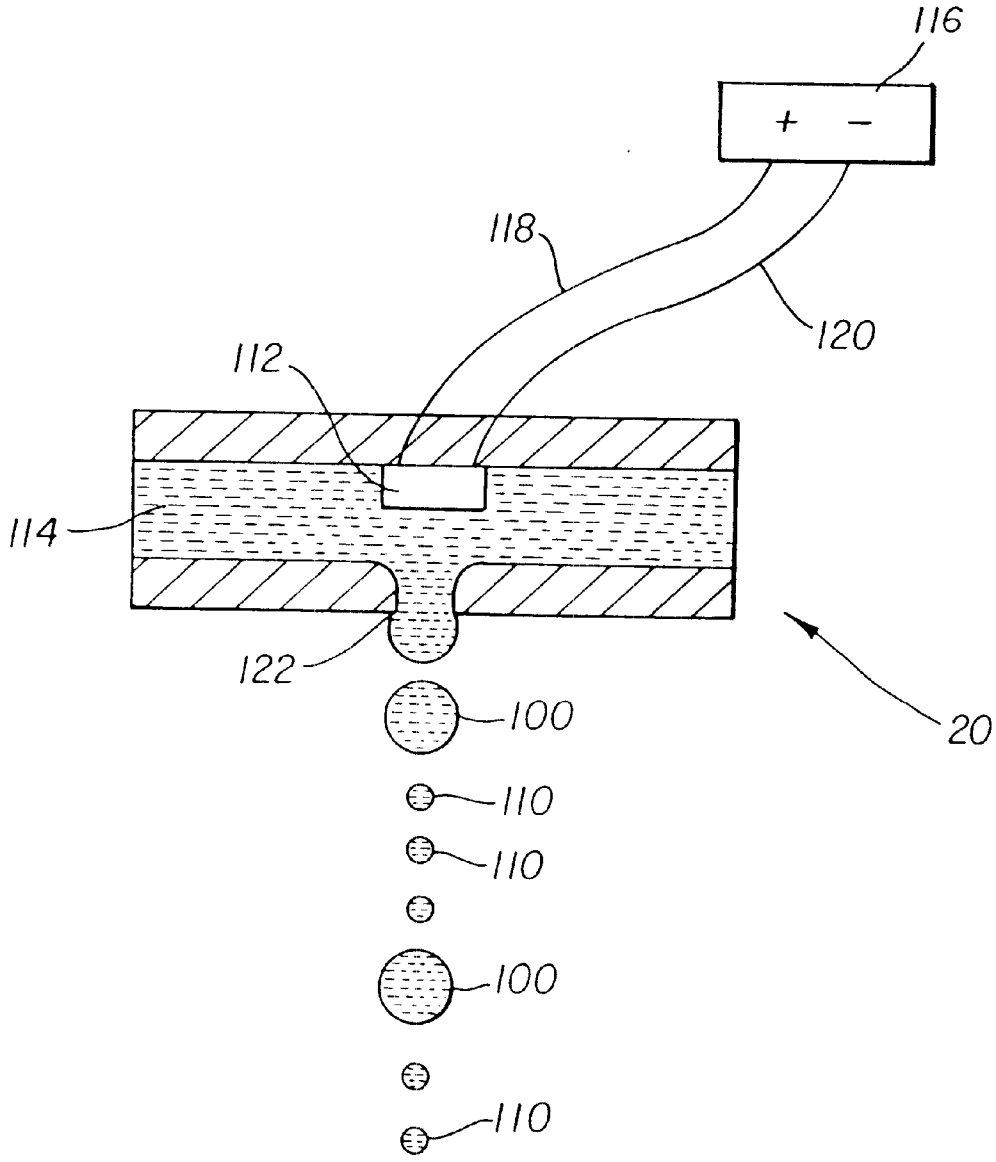
FIG. 6 is a schematic view of an alternative embodiment made in accordance with the present invention.

Referring to FIG. 6, another alternative embodiment of the present invention is shown. In FIG. 6, printhead 20 includes an actuator 112 positioned within an ink delivery channel 114. Actuator 112 is electrically connected to a voltage source 116 through electrodes 118 and 120. When actuated at a plurality of amplitudes and/or frequencies, actuator 112 forms large droplets 100 and small droplets 110 and forces large droplets 100 and small droplets 110 through nozzle 122. Large droplets 100 and small droplets 110 are then separated as described above in reference to FIG. 3. In this embodiment, actuator 112 is a piezoelectric actuator. However, it is specifically contemplated that actuator 112 can also include other types of electrostrictive actuators, thermal actuators, etc.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

| PARTS LIST | |
|---|---|
| 10 | ink drop forming mechanism |
| 14 | nozzle |
| 15 | nozzle edge |
| 16 | heater |
| 17 | heating element |
| 18 | conductor |
| 20 | printhead |
| 22 | pad |
| 30 | ink supply |
| 40 | controller |
| 45 | droplet deflector system |
| 46 | force |
| 48 | gas source |
| 50 | air current generator |
| 52 | plenum |
| 54 | baffle |
| 70 | drive roller |
| 72 | idle roller |
| 80 | recovery plenun |
| 82 | baffle |
| 84 | ink recovery conduit |
| 85 | splashguard |
| 86 | vacuum conduit |
| 88 | catcher surface |
| 90 | negative pressure source |
| 92 | ink recycler |
| 94 | pressurized ink |
| 96 | filament of working fluid |
| 98 | stream of individual ink droplets |
| 100 | large droplet |
| 110 | small droplet |
| 112 | actuator |
| 114 | ink delivery channel |
| 116 | voltage source |
| 118 | electrode |
| 120 | electrode |
| 122 | nozzle |
| W | print media |
| L | interaction distance |
| S | Separation distance |
| D | deflection angle |
| X | ejection path |

What is claimed is:

1. An apparatus for printing an image comprising:

an ink droplet forming mechanism configured to selectively create a stream of ink droplets having a plurality of volumes, at least one volume of said plurality of volumes being formed in succession; and a droplet deflector having a continuous gas flow positioned at an angle with respect to said stream of ink droplets, said gas flow continuously interacting with said stream of ink droplets, thereby separating ink droplets having one of said plurality of volumes from ink droplets having another of said plurality of volumes.

2. The apparatus according to claim 1, further comprising:

a catcher shaped to collect said ink droplets having another of said plurality of volumes, said catcher being positioned below said stream of ink droplets.

3. The apparatus according to claim 1, wherein said gas flow is a positive pressure flow.

4. The apparatus according to claim 3, wherein said gas flow includes air.

5. The apparatus according to claim 1, wherein said gas flow is positioned substantially perpendicular to said stream of ink droplets.

6. The apparatus according to claim 1, wherein said stream of ink droplets includes small volume droplets and large volume droplets, said gas flow interacting with said large volume droplets and said small volume droplets such that said small volume droplets diverge from said stream of ink droplets.

7. The apparatus according to claim 1, wherein said droplet forming mechanism includes a heater.

8. An apparatus for printing an image comprising:

an ink droplet forming mechanism configured to selectively create a stream of ink droplets having a plurality of volumes; and a droplet deflector having a gas flow positioned at an angle with respect to said stream of ink droplets, said gas flow interacting with said stream of ink droplets, thereby separating ink droplets having one of said plurality of volumes from ink droplets having another of said plurality of volumes, wherein said ink droplet forming mechanism includes a nozzle and a heater positioned proximate said nozzle, said heater being adapted to selectively create said stream of ink droplets having said plurality of volumes.

9. The apparatus according to claim 8, wherein said heater is operable to be selectively actuated at a plurality of frequencies thereby creating said stream of ink droplets having said plurality of volumes.

10. The apparatus according to claim 8, wherein said heater is ring shaped and positioned about said nozzle.

11. The apparatus according to claim 8, wherein said gas flow includes a continuous gas flow.

12. An apparatus for printing an image comprising:

an ink droplet forming mechanism configured to selectively create a stream of ink droplets having a plurality of volumes; and a droplet deflector having a gas flow positioned at an angle with respect to said stream of ink droplets, said gas flow interacting with said stream of ink droplets, thereby separating ink droplets having one of said plurality of volumes from ink droplets having another of said plurality of volumes, wherein said droplet deflector includes at least one baffle shaped to direct said gas flow toward said stream of ink droplets.

13. The apparatus according to claim 12, wherein said droplet forming mechanism includes a heater.

14. The apparatus according to claim 12, wherein said gas flow includes a continuous gas flow.

15. An apparatus for printing an image comprising:

an ink droplet forming mechanism configured to selectively create a stream of ink droplets having a plurality of volumes; and a droplet deflector having a gas flow positioned at an angle with respect to said stream of ink droplets, said gas flow interacting with said stream of ink droplets, thereby separating ink droplets having one of said plurality of volumes from ink droplets having another of said plurality of volumes, wherein said droplet deflector includes a recovery plenum positioned adjacent said stream of ink droplets shaped to collect and remove said ink droplets having another of said plurality of volumes.

16. The apparatus according to claim 15, wherein said droplet deflector includes a negative pressure source connected to said recovery plenum operable to create a negative pressure, thereby increasing removal of said ink droplets having another of said plurality of volumes.

17. The apparatus according to claim 16, further comprising an ink recycler connected to said recovery plenum.

18. The apparatus according to claim 15, wherein said droplet forming mechanism includes a heater.

19. The apparatus according to claim 15, wherein said gas flow includes a continuous gas flow.

20. An apparatus for printing an image comprising:

an ink droplet forming mechanism adapted to selectively create a stream of ink droplets having a plurality of volumes, at least one volume of said plurality of volumes of said ink droplets being created in succession; and a droplet deflector having a gas flow positioned at an angle with respect to said stream of ink droplets, said gas flow interacting with said stream of ink droplets, thereby separating ink droplets having one of said plurality of volumes from ink droplets having another of said plurality of volumes, wherein said gas flow includes a negative pressure flow positioned at an angle relative to said stream of ink droplets, said negative pressure flow creating a negative air pressure across said stream of ink droplets, thereby separating ink droplets having one of said plurality of volumes from ink droplets having another of said plurality of volumes.

21. The apparatus according to claim 20, wherein said droplet forming mechanism includes a heater.

22. The apparatus according to claim 20, wherein said negative pressure flow is continuous.

23. An ink jet printer for printing an image comprising:

a printhead having a nozzle configured to selectively create a stream of ink droplets having a plurality of volumes, at least one volume of said plurality of volumes being formed in succession; and a droplet deflector having a continuous gas flow positioned at an angle with respect to said stream of ink droplets operable to continuously interact with said stream of ink droplets, thereby separating ink droplets having one of said plurality of volumes from ink droplets having another of said plurality of volumes.

24. The apparatus according to claim 23, wherein said printhead includes a heater.

25. An ink jet printer for printing an image comprising:

a printhead having a nozzle configured to selectively create a stream of ink droplets having a plurality of volumes, a heater positioned proximate said nozzle, said heater being operable to selectively create said stream of ink droplets having a plurality of volumes; and a droplet deflector having a gas flow positioned at an angle with respect to said stream of ink droplets operable to interact with said stream of ink droplets, thereby separating ink droplets having one of said plurality of volumes from ink droplets having another of said plurality of volumes.

26. The ink jet printer according to claim 25, further comprising:

a controller electrically coupled to said heater, said controller being operable to selectively actuate said heater at a plurality of frequencies, thereby creating said stream of ink droplets having said plurality of volumes.

27. The apparatus according to claim 25, wherein said gas flow includes a continuous gas flow.

28. A method of printing an image comprising:

selectively forming a stream of ink droplets having a plurality of volumes, at least one volume of the plurality of volumes being formed in succession;

providing a continuous gas flow at an angle with respect to the stream of ink droplets;

separating ink droplets having one of said plurality of volumes in the stream of ink droplets from ink droplets having another of said plurality of volumes in the stream of ink droplets using the continuous gas flow;

collecting the ink droplets having another of said plurality of volumes; and allowing the ink droplets having one of said plurality of volumes to contact a print media.

29. The method according to claim 28, further comprising recycling the ink droplets having another of said plurality of volumes for subsequent use.

30. The method according to claim 28, wherein selectively forming the stream of ink droplets having the plurality of volumes includes actuating a heater.

31. A method of printing an image comprising:

selectively forming a stream of ink droplets having a plurality of volumes by selectively actuating a heater at a plurality of frequencies;

providing a gas flow at an angle with respect to the stream of ink droplets;

separating ink droplets having one of said plurality of volumes in the stream of ink droplets from ink droplets having another of said plurality of volumes in the stream of ink droplets;

collecting the ink droplets having another of said plurality of volumes; and allowing the ink droplets having one of said plurality of volumes to contact a print media.

32. An apparatus for printing an image comprising:

a droplet forming mechanism operable in a first state to form droplets having a first volume travelling along a path and in a second state to form droplets having a second volume travelling along said path, at least one of said droplets having said first volume and said droplets having said second volume being formed in succession; and a system which applies force to said droplets travelling along said path, said force being applied in a direction such as to separate droplets having said first volume from droplets having said second volume, said force including a continuous gas flow applied to said droplets having said first volume and said droplets having said second volume.

33. The apparatus according to claim 32, wherein said force is a positive pressure force.

34. The apparatus according to claim 32, wherein said force is applied in a direction substantially perpendicular to said path.

35. The apparatus according to claim 32, wherein said gas flow is applied in a direction substantially perpendicular to said path such as to separate droplets having said first volume from droplets having said second volume.

36. The apparatus according to claim 32, wherein said droplet forming mechanism includes a heater.

37. An apparatus for printing an image comprising:

a droplet forming mechanism operable in a first state to form droplets having a first volume travelling along a path and in a second state to form droplets having a second volume travelling along said path, at least one of said droplets having said first volume and said droplets having said second volume being formed in succession; and a system which applies force to said droplets travelling along said path, said force being applied in a direction such as to separate droplets having said first volume from droplets having said second volume, wherein said force is a negative pressure force.

38. The apparatus according to claim 37, wherein said direction is substantially perpendicular to said path.

39. The apparatus according to claim 37, wherein said droplet forming mechanism includes a heater.

40. The apparatus according to claim 37, wherein said negative pressure force is continuous.

41. An apparatus for printing an image comprising:

a droplet forming mechanism operable in a first state to form droplets having a first volume travelling along a path and in a second state to form droplets having a second volume travelling along said path; and a system which applies force to said droplets travelling along said path, said force being applied in a direction such as to separate droplets having said first volume from droplets having said second volume, wherein said droplet forming mechanism includes a heater operable in said first state to form said droplets having said first volume travelling along said path and in said second state to form said droplets having a second volume travelling along said path.

42. The apparatus according to claim 41, further comprising:

a controller electrically coupled to said heater, said controller operable to activate said heater at a plurality of frequencies such that said droplets having said first volume and said droplets having said second volume are formed.

43. The apparatus according to claim 41, wherein said force includes a continuous gas flow.

44. A method of diverging ink droplets comprising:

forming droplets having a first volume travelling along a path;

forming droplets having a second volume travelling along the path, at least one of the droplets having the first volume and the droplets having the second volume being formed in succession; and causing at least the droplets having the first volume to diverge from the path by applying a force including a continuous gas flow to the droplets having the first volume and the droplets having the second volume.

45. The method according to claim 44, wherein applying the force includes applying the force along the path.

46. The method according to claim 44, wherein applying the force includes applying the force in a direction such as to separate the droplets having the first volume from droplets having the second volume.

47. The method according to claim 46, wherein applying the force includes applying the force in a direction substantially perpendicular to the path.

48. The method according to claim 44, wherein forming droplets having the first volume travelling along the path and forming droplets having the second volume travelling along the path includes actuating a heater.

49. The apparatus according to claim 8, wherein said heater is adapted to create at least one volume of said plurality of volumes of said ink droplets in succession.

50. The ink jet printer according to claim 25, wherein said heater is adapted to create at least one volume of said plurality of volumes of said ink droplets in succession.

51. The apparatus according to claim 41, wherein said heater is adapted to create at least one volume of said plurality of volumes of said ink droplets in succession.

52. The method according to claim 31, wherein selectively forming the stream of ink droplets having the plurality of volumes by selectively actuating the heater at the plurality of frequencies includes forming at least one volume of the plurality of volumes of the ink droplets in succession by actuating the heater at the same frequency.

53. The apparatus according to claim 20, wherein said ink droplet forming mechanism is adapted to create each volume of said plurality of volumes in succession.

54. The apparatus according to claim 37, wherein said droplet forming mechanism is operable to form each of said droplets having said first volume and said droplets having said second volume in succession.

55. The apparatus according to claim 1, wherein said ink droplet forming mechanism is adapted to create each volume of said plurality of volumes in succession.

56. The ink jet printer according to claim 23, wherein said ink droplet forming mechanism is adapted to create each volume of said plurality of volumes in succession.

57. The method according to claim 28, wherein selectively forming the stream of ink droplets having the plurality of volumes includes forming each of the plurality of volumes in succession.

58. The apparatus according to claim 32, wherein said droplet forming mechanism is operable to form each of said droplets having said first volume and said droplets having said second volume in succession.

59. The method according to claim 44, wherein forming the droplets having the first volume and forming the droplets having the second volume includes forming each of the droplets having the first volume and the droplets having the second volume in succession.

* * * * *